US012742268B2

(12) United States Patent
Pierce et al.

(10) Patent No.: US 12,742,268 B2
(45) Date of Patent: Sep. 22, 2026

(54) STRETCHABLE OUTDOOR COVER PRODUCT

(71) Applicant: International Textile Group, Inc., Greensboro, NC (US)

(72) Inventors: John Pierce, Greensboro, NC (US); Lon Beasley, Greensboro, NC (US); Steve Simonson, Greensboro, NC (US)

(73) Assignee: Elevate Textiles, Inc., Greensboro, NC (US)

( * ) Notice: Subject to any disclaimer, the term of this patent is extended or adjusted under 35 U.S.C. 154(b) by 691 days.

(21) Appl. No.: 16/267,967

(22) Filed: Feb. 5, 2019

(65) Prior Publication Data

US 2019/0242035 A1 Aug. 8, 2019

Related U.S. Application Data

(60) Provisional application No. 62/626,359, filed on Feb. 5, 2018.

(51) Int. Cl.
*D03D 1/00* (2006.01)
*D03D 15/47* (2021.01)
*D03D 15/54* (2021.01)

(52) U.S. Cl.
CPC ..... *D03D 1/00* (2013.01); *D03D 15/47* (2021.01); *D03D 15/54* (2021.01); *D10B 2503/10* (2013.01); *D10B 2505/18* (2013.01)

(58) Field of Classification Search
CPC ..... D03D 15/47; D03D 15/54; D03D 17/00; D03D 15/49; D03D 15/41; D10B 2503/00; D10B 2503/10; D10B 2505/00; D10B 2505/18; D10B 2321/021; D10B 2321/02; D10B 2321/022; D10B 2321/042; D10B 2331/02; D10B 2331/021; D10B 2331/04; D10B 2331/041; D10B 2331/042; D01D 1/00; A45B 2025/18; A45B 2025/183; E04H 15/06
USPC ..... 442/181–184, 79, 81, 82, 86, 87, 88
See application file for complete search history.

(56) References Cited

U.S. PATENT DOCUMENTS

| | | | | | |
|---|---|---|---|---|---|
| 3,365,329 | A | | 1/1968 | Mackenzie, Jr. et al. | |
| 3,467,482 | A | | 9/1969 | Maerov | |
| 3,972,174 | A | * | 8/1976 | London, Jr | D02G 1/024 57/208 |
| 4,244,171 | A | * | 1/1981 | Sasaki | D02G 1/205 57/208 |
| 4,965,919 | A | * | 10/1990 | Fujita | D02G 3/24 28/220 |

(Continued)

FOREIGN PATENT DOCUMENTS

| | | | | | |
|---|---|---|---|---|---|
| EP | 3121318 | A1 | * | 1/2017 | D03D 15/0061 |
| JP | 2006052505 | A | * | 2/2006 | |
| WO | WO-2012062480 | A2 | * | 5/2012 | D02G 3/326 |

OTHER PUBLICATIONS

"Water Repellents", 2021, Bolger & O'Hearn Specialty Chemicals (Year: 2021).*

(Continued)

*Primary Examiner* — Braelyn R Watson
(74) *Attorney, Agent, or Firm* — Dority & Manning, P.A.

(57) ABSTRACT

An outdoor cover product is disclosed. The outdoor cover product is water resistant and breathable. The product is made from a woven fabric that has excellent stretch properties in multiple directions.

21 Claims, 3 Drawing Sheets

(56) References Cited

U.S. PATENT DOCUMENTS

| | | | | |
|---|---|---|---|---|
| 5,447,540 | A | 9/1995 | Kobayashi | |
| 5,447,787 | A * | 9/1995 | Shaffer | D03D 15/00 442/2 |
| 6,092,563 | A | 7/2000 | Swers et al. | |
| 6,253,777 | B1 * | 7/2001 | Anderson | E04H 15/54 135/117 |
| 6,557,590 | B2 | 5/2003 | Swers et al. | |
| 6,561,230 | B1 | 5/2003 | Ikeda | |
| 6,720,277 | B1 * | 4/2004 | Howland | D03D 1/00 2/2.5 |
| 6,750,162 | B2 | 6/2004 | Underwood et al. | |
| 7,049,252 | B2 | 5/2006 | Underwood et al. | |
| 7,681,417 | B2 | 3/2010 | Hagihara et al. | |
| 8,263,505 | B2 * | 9/2012 | Mortimer | D03D 1/04 442/208 |
| 8,445,392 | B2 | 5/2013 | Rosset et al. | |
| 9,121,131 | B2 | 9/2015 | Underwood et al. | |
| 2003/0104134 | A1 | 6/2003 | Linford et al. | |
| 2003/0116744 | A1 | 6/2003 | Kimbrell | |
| 2004/0077238 | A1 | 4/2004 | Audenaert et al. | |
| 2004/0128770 | A1 | 7/2004 | Copeland et al. | |
| 2004/0152381 | A1 | 8/2004 | York et al. | |
| 2004/0234718 | A1 | 11/2004 | Hawes | |
| 2004/0242098 | A1 | 12/2004 | Bass | |
| 2005/0014433 | A1 | 1/2005 | Langley et al. | |
| 2007/0072502 | A1 * | 3/2007 | Underwood | C09D 5/18 442/82 |
| 2008/0096001 | A1 | 4/2008 | Emden | |
| 2013/0059495 | A1 * | 3/2013 | Dempster | D01D 5/22 442/181 |
| 2015/0079865 | A1 * | 3/2015 | Minor | D01D 5/247 428/398 |
| 2017/0051440 | A1 | 2/2017 | Bagwell | |
| 2019/0016957 | A1 * | 1/2019 | Nash | C01B 33/159 |

OTHER PUBLICATIONS

Predominate English Definition and Meaning, Lexico.com Dictionary (Year: 2022).*

English translation of JP-2006052505-A obtained from Espacenet (Year: 2006).*

Ng, S. F., Chi Leung Hui, and C. Ip. "Dimensional stability of fabrics: resistance to shrinkage and other dimensional changes." Understanding and Improving the Durability of Textiles. Elsevier Ltd, 2012. 59-69. (Year: 2012).*

AATCC Technical Manual, Colorfastness to Light, 2005.

Textile Glossary, Celanese Acetate copyright 2001 (Year: 2001).

* cited by examiner

STRETCHABLE OUTDOOR COVER PRODUCT

RELATED APPLICATIONS

The present application is based upon and claims priority to U.S. Provisional Application Ser. No. 62/626,359, having a filing date of Feb. 5, 2018, which is incorporated herein by reference in its entirety.

BACKGROUND

Fabrics that are appropriate for use in outdoor applications must be durable and must be able to withstand weather conditions and other harsh conditions to which they are often subjected. In designing a fabric for use in outdoor applications, it is important to look at factors including hydrostatic pressure and UV resistance properties. In addition, factors such as appearance, breathability, dimensional stability, abrasion resistance, mark off resistance, and ease of fabrication are also very important. For various applications, fire resistance is also of importance. Environmental considerations are important as well.

In the past, the water resistant properties of fabrics used in outdoor applications were improved by laminating a fabric to a polymer film or coating the fabric with a polymer composition that forms a film over a surface of the fabric, which are referred to herein as "coated" fabrics. Although coated fabrics can be made with excellent waterproof properties, the coated fabrics present a number of drawbacks. For instance, coated fabrics are not breathable or have limited breathability. In addition, the polymer film present on one side of the fabric can cause water vapors to be trapped on the uncoated side of the fabric leading to the formation of mildew. Coated fabrics are usually heavy, lack certain aesthetic qualities, and can be very costly to produce.

In view of the above, non-coated fabrics have been produced in the past for outdoor applications. For instance, United States Patent Publication No. 2011/0165807 discloses a noncoated fabric for outdoor applications that comprises a woven fabric impregnated with a chemical composition. The '807 application is incorporated herein by reference. The outdoor fabrics disclosed in the '807 application have made great advances in the art and have proven to be weatherable and durable.

The present disclosure is directed to further improvements in fabrics for outdoor applications. In particular, a need still remains for an uncoated outdoor woven fabric that is not only weather-resistant and breathable, but that also possesses stretch properties. Specifically, outdoor fabrics made in the past were typically made from woven fabrics having a weave that allowed little to no stretch in either the length direction or the width direction. The fabrics were made with little to no stretch in order to produce a fabric with dimensional stability. The present disclosure, however, is directed to outdoor fabric products that have stretch characteristics in more than one direction.

SUMMARY

In general, the present disclosure is directed to an outdoor cover product and to fabrics incorporated into the product. In accordance with the present disclosure, the fabric is not only breathable and weather resistant, but also has stretch properties in at least two directions. The fabric of the present disclosure is durable and long-term UV resistant and fade resistant. Of particular advantage, the fabric has flexibility due to its stretch properties allowing the fabric to have form-fitting properties that can easily cover a frame when used as, for instance, an umbrella or a shade awning, or can easily fit over a product, such as outdoor furniture, a boat, a vehicle, or the like.

In addition to having form-fitting properties, the stretchable woven fabric of the present disclosure has various other benefits and advantages. For instance, the fabric has excellent light blocking characteristics. For instance, the fabric can be designed not only to block a major amount of light but does so in a uniform manner.

In one embodiment, the outdoor cover product of the present disclosure comprises a cover having an interior surface and an exterior surface. The cover has a shape adapted to cover an outdoor structure. The exterior surface of the cover has a UV rating of at least 800 hours and is water resistant such that the fabric has a spray rating when tested according to Test AATCC 22 of greater than 90, such as even 100.

The outdoor cover product is generally made from a woven fabric. The woven fabric is comprised of multifilament yarns. The multifilament yarns are texturized yarns that can have greater than about 80 tie downs per meter, such as greater than about 90 tie downs per meter, such as greater than about 95 tie downs per meter, and generally less than about 175 tie downs per meter, such as less than about 150 tie downs per meter. The multifilament yarns can have a denier of generally from about 50 to about 800. The multifilament yarns extend in both the warp direction and the fill direction of the fabric. In accordance with the present disclosure, the fabric has a stretch of at least about 5% in the warp direction and a stretch of at least about 8% in the fill direction when tested according to ASTM Test D3107 at a load of 4 lbs. For example, in one embodiment the stretch in the warp direction and the stretch in the fill direction can be greater than about 10%. In one embodiment, the fabric may have greater stretch in the fill direction than the warp direction. For instance, the fill direction may have a stretch of greater than about 15%.

The multifilament yarns may contain polyester filaments, polyimide filaments, polypropylene filaments, polyethylene filaments, polytetrafluoroethylene filaments, and mixtures thereof. In one embodiment, the fabric can be made from multifilament yarns that have been solution dyed. In one embodiment, the fabric can have a basis weight of from about 4.5 osy to about 9.5 osy. In accordance with the present disclosure, the outdoor cover product may comprise a single layer of fabric and can be non-coated and non-laminated. In particular, the fabric used to make the outer cover product may not be laminated to other film or fabric layers and may not include a coating that forms a film on one surface of the fabric. The fabric, however, can be impregnated with a chemical composition. In one embodiment, for instance, the fabric can be impregnated with a water resistant finish. The water resistant finish can improve water resistance and the spray rating of the fabric.

As described above, the multifilament yarns can generally have a denier of from about 50 to about 800. In one embodiment, the denier of the yarns can be from about 100 to about 600. The denier of the yarns in the warp direction can be the same as the denier of the yarns in the fill direction. For example, in one embodiment, the denier of the warp yarns and the denier of the fill yarns can be from about 250 to about 350, Alternatively, the denier of the warp yarns can be different than the denier of the fill yarns. In one embodiment, for instance, the denier of the warp yarns can be from about 250 to about 350 and the denier of the fill yarns can be from about 350 to about 650 or vice versa. In general, the warp direction can generally contain from about 40 yarns per inch to about 70 yarns per inch. The fill direction, on the other hand can generally contain from about 30 yarns per inch to about 60 per inch.

The outdoor cover product and the fabric used to make the cover product can have various properties and characteristics that make the product amenable to outdoor applications. For instance, when tested according to Test AATCC 127, the fabric can have a hydrostatic pressure of at least 9 cm, such as at least 10 cm, such as at least 11 cm. For instance, the hydrostatic pressure can be from about 11 cm to about 20 cm, such as from about 11 cm to about 15 cm. The outdoor cover product can also be breathable. For instance, the outdoor cover product and the fabric when tested according to ASTM Test D737, can have an air permeability of at least 50 cfm, such as at least 53 cfm, such as at least 55 cfm, such as at least 58 cfm. The air permeability is generally less than 110 cfm.

In one particular embodiment, the outdoor cover product can have the properties indicated above and can be made from multifilament yarns containing polyimide filaments, polyester filaments, or mixtures thereof.

The outdoor cover product of the present disclosure can be used in numerous and diverse applications. In one embodiment, the outdoor cover product can be used to cover a frame. In this regard, the present disclosure can be directed to an umbrella and/or an awning containing a frame that is covered by the outdoor cover product. In an alternative embodiment, the outdoor cover product can be shaped to fit over an article. For instance, the outdoor cover product may comprise a furniture cover, a boat cover, a vehicle cover, or a non-framed shade.

Other features and aspects of the present disclosure are discussed in greater detail below.

Definitions and Standardized Procedures

The following definitions and procedures are offered in order to better describe and quantify the performance fabrics made according to the present disclosure.

Thickness Test

The thickness test measures the thickness of the fabric. The test is known in the art and conforms to ASTM D 1777-96 (Reapproved 2015). The results are expressed in millimeters.

A fabric is placed on the base of a thickness gage and a weighted presser foot is lowered. The displacement between the base and the presser foot is measured as the thickness of the fabric.

Water Repellency: Spray Rating Test

The spray rating test measures the resistance of fabrics to wetting by water. The test is known in the art and conforms to AATCC 22-2017. The results are expressed on a scale of 0 to 100 with 0 indicating a complete wetting of whole upper and lower surfaces and 100 indicating no sticking or wetting of the upper surface.

Water sprayed against the taut surface of a test specimen under controlled conditions produces a wetted pattern whose size depends on the relative repellency of the fabric. Evaluation is accomplished by comparing the wetted pattern with pictures on a standard chart, Air Permeability Air permeability can be used to provide an indication of the breathability of weather resistant and rainproof fabrics. The air permeability test is known in the art and conforms to ASTM D 737-2016. The results are expressed in cubic feet/square feet minute (cfm).

The rate of air flow passing perpendicularly through a known area of fabric is adjusted to obtain a prescribed air pressure differential between the two fabric surfaces. From this rate of air flow, the air permeability is determined, Water Resistance: Hydrostatic Pressure Test The hydrostatic pressure test measures the resistance of a fabric to the penetration of water under hydrostatic pressure. The test is known in the art and conforms to AATC 127-2017. The results are expressed in cm H2O.

One surface of the test specimen is subjected to a hydrostatic pressure, increasing at a constant rate, until three points of leakage appear on its other surface. The water may be applied from above or below the test specimen.

Stiffness of Fabric by the Circular Bend Procedure

The circular bend procedure gives a force value related to fabric stiffness, simultaneously averaging stiffness in all directions. The test is known in the art and conforms to ASTM D 4032-94 (Reapproved 2016).

A plunger forces a flat, folded swatch of fabric through an orifice in a platform. The maximum force required to push the fabric through the orifice is an indication of the fabric stiffness (resistance to bending).

Breaking Strength and Elongation of Textile Fabrics (Grab Test)

The grab tensile test used herein measures breaking strength of a fabric when subjected to unidirectional stress. This test is known in the art and conforms to ASTM D 5034-2017. The results are expressed in pounds to break. Higher numbers indicate a stronger fabric. The values noted herein, measured in pounds, represent the "load" or the maximum load or force, expressed in units of weight, required to break or rupture the specimen in a tensile test.

The grab tensile test uses two clamps, each having two jaws with each jaw having a facing in contact with the fabric sample. The clamps hold the fabric in the same plane, usually vertically, separated by approximately three inches and move apart at a specified rate of extension. The sample is wider than the clamp jaws to give results representative of effective strength of yarns in the clamped width combined with additional strength contributed by adjacent yarns in the fabric. Usually, a grab tensile strength test closely simulates fabric stress conditions in actual use. Results are reported as an average of three specimens and may be performed with the specimen in the cross direction or the machine direction.

Tearing Strength of Fabrics by the Tongue (Single Rip) Procedure

Tear strength, as measured in this test method, requires that the tear be initiated before testing. The reported value obtained is not directly related to the force required to initiate or start of a tear. The test method used is known in the art and conforms to ASTM D 2261-96 (Reapproved 2017).

A rectangular specimen, cut in the center of a short edge to form a two-tongued (trouser shaped) specimen, in which one tongue of the specimen is gripped in the upper jaw and the other tongue is gripped in the lower jaw of a tensile testing machine. The separation of the jaws is continuously increased to apply a force to propagate the tear. At the same time, the force developed is recorded. The force to continue the tear is calculated from autographic chart recorders or microprocessor data collection systems.

Abrasion Resistance of Textile Fabrics Rotary Platform, Double-Head Method)

The abrasion cycle is dependent on the programmed motions of the abrasion machine and the test standard used. It may consist of one back and forth unidirectional movement such as for the rotary platform test method. The test method used is known in the art and conforms to ASTM D 3884-09 (reapproved in 2017).

A specimen is abraded using rotary rubbing action under controlled conditions of pressure and abrasive action. The test specimen, mounted on a platform, turns on a vertical axis, against the sliding rotation of two abrading wheels. One abrading wheel rubs the specimen outward toward the periphery and the other, inward toward the center. The resulting abrasion marks form a pattern of crossed arcs over an area of approximately 30 $cm^2$.

Ultraviolet Rating Test

Two methods are used to determine ultraviolet rating. The accelerated exposure test is designed to accelerate extreme environmental conditions encountered due to sunlight, heat, and moisture for the purpose of predicting the performance of materials. The colorfastness to light test tests the resistance of a material to a change in its color characteristics as a result of exposure of the material to sunlight or an artificial light source. The test methods used are known in the art and conform to AATC Test Method 169-2017 revision Xenon light and AATC Test Method 186-2015 revision Pure UV exposure, Oil Repellency and Water Repellency Oil repellency is measured according to AATCC Test Method 118-2013 and water repellency is measured according to AATCC Test Method 193-2017.

Stretch Properties

The stretch of a fabric in one direction is determined according to ASTM Test D3107-07 (reapproved in 2015) at a bad of 4 lbs. Stretch can be measured in the warp direction and in the fill direction. Stretch is measured in percent.

Burst Strength

The burst strength of a fabric also known as the "Diaphragm Burst" is tested in accordance with ASTM Test D3786-13. The results are measured in pounds. The test determines the diaphragm bursting strength of a fabric.

BRIEF DESCRIPTION OF THE DRAWINGS

A full and enabling disclosure of the present disclosure, including the best mode thereof to one of ordinary skill in the art, is set forth more particularly in the specification, including reference to the accompanying Figures in which.

Figure 1:
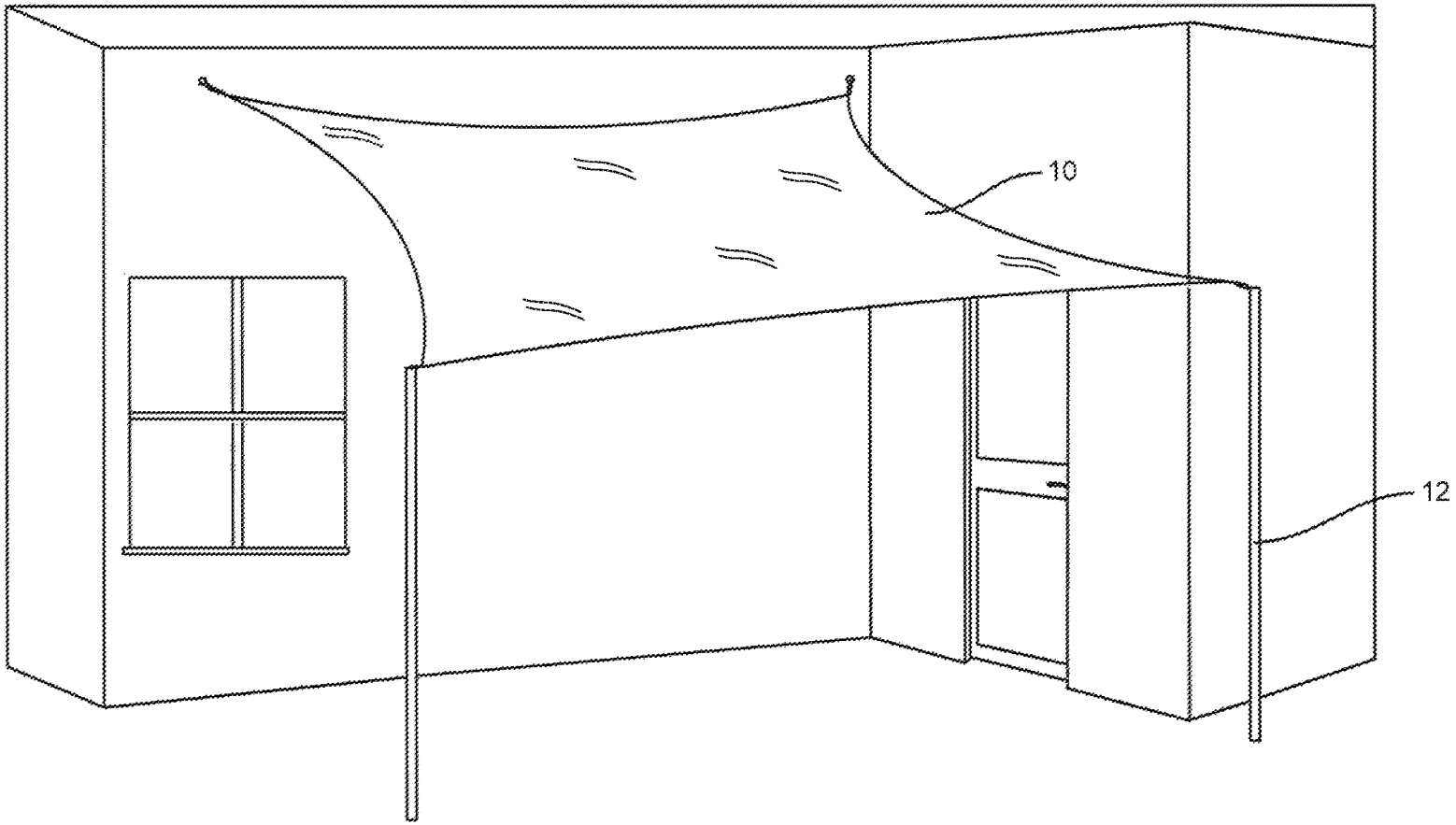
FIG. 1 represents a shade structure in accordance with one embodiment of the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure, which broader aspects are embodied in the exemplary construction.

In general, the present disclosure is directed to an outdoor cover product and fabric suitable for outdoor applications that may have, UV resistant properties, and/or fire resistant properties. In accordance with the present disclosure, the outdoor cover product also has excellent stretch properties. In one embodiment, for instance, the outdoor cover product can be made with a fabric that has excellent stretch characteristics in at least two different directions, such as orthogonal directions. In addition to being stretchable, the woven fabric of the present disclosure also has excellent light blocking properties. For example, the woven fabric can be made in order to block a substantial amount of light, in addition, the fabric can be constructed so that no openings or pinholes are formed allowing for very uniform light blocking characteristics. In addition, the woven fabric has excellent resistance to the penetration of liquids. For example, the woven fabric of the present disclosure can have excellent resistance properties to the penetration of water under hydrostatic pressure without the mark off typical of those coated and noncoated fabrics.

Producing an outdoor fabric with multi-directional stretch properties provides numerous benefits and advantages. For instance, in the past, outdoor fabrics were purposefully made to have dimensional stability and therefore no stretch properties. Thus, significant problems were encountered in attempting to fit the fabrics on complex patterns or forms. The outdoor cover product of the present disclosure, however, has stretch properties that allow the fabric when placed over a 3-dimensional article or object to have form-fitting properties. Not only can the fabric conform to the shape of an object or article, but the fabric allows for easier placement over such articles or structures. Because the fabric of the present disclosure has stretch properties in multiple directions, the fabric is soft and pliable while still retaining excellent tear properties. The outdoor cover product also protects from other outdoor elements such as visible light, infra-red heat, heat, organic particles, pollution residuals, bird droppings, and the like.

In order for the fabric of the present disclosure to be strong and tear resistant, the fabric can be made from multifilament yarns. The multifilament yarns can provide greatly improved abrasion resistance. The multifilament yarns can be solution dyed and enhanced with UV stabilizers so that the yarns and the fabric can have greatly improved UV resistance. In this regard, UV stabilizers can include UV absorbers and the like. The chemical composition can also maintain air permeability. Finally, the chemical composition allows for fire resistant capability.

Fabrics that are suitable for use in the process of the present disclosure may be manufactured with yarns made from inelastic polymer filaments, such as polyamide (nylon), polyester, polypropylene, polytetrafluoroethylene, polyethylene, mixtures thereof, and other similar yarns. For many applications, polyester and/or polyamide filaments are used to construct the yarns. In one exemplary embodiment, SATURA yarns are utilized which are commercially available from Unifi, Inc. The SATURA yarns are solution dyed with specialty pigments commercially available from American Colors. In addition, UV stabilizers are added to the yarns. In a solution dyed yarn, pigments and UV stabilizers are added while the yarn is still in a liquid state. In some embodiments, the UV stabilizer utilized is SATURAMAX UV absorber which is commercially available from Unifi, Inc. The components become part of the fibers and resist fading or washing out.

It has also been found that UV resistance can be greatly increased using such yarns. In some embodiments, the UV rating of the fabrics is at least 500 hours. In some embodiments, the UV rating of the fabrics is from about 500 hours to about 1500 hours. In some embodiments, the UV rating of the fabrics is at least 800 hours. In still other embodiments, the UV rating of the fabrics is at least 1000 hours. In some embodiments, the UV rating of the fabrics is from about 800 hours to about 1500 hours. In some embodiments, the UV rating of the fabrics is from about 1000 hours to about 1200 hours. High UV resistance characteristics in fabrics are important for color and strength retention.

The yarns used in the fabric of the present disclosure may be woven into various constructions. A particular weave may be selected to provide durability, breathability, and ease of fabrication. In accordance with the present disclosure, the yarns are woven into a fabric that has multidirectional stretch properties. Any suitable weave can be used to construct the fabric, such as a plain weave, a twill weave, a rip stop weave, a herringbone weave, or the like.

In order to incorporate stretch into the woven fabric, in one embodiment, the fabric is constructed from textured yarn that can include a significant amount of crimps or tie downs. The fabric can be woven with a relatively loose weave and then subjected to a shrinking process that shrinks the fabric in at least one direction, such as in both directions, and tightens the weave providing the fabric with greater dimensional stability. The fabric is then dried in a somewhat relaxed state that results in a fabric having stretch characteristics in at least one direction, such as in both directions.

For example, woven fabrics made according to the present disclosure can have a stretch of at least about 8% in the warp direction and a stretch of at least about 8% in the fill direction. Stretch can be measured according to ASTM Test 03107 at a load of 4 lbs. Of particular advantage, woven fabrics made according to the present disclosure can have the above stretch properties while being constructed only of inelastic multifilament yarns. For example, the fabric of the present disclosure can have multidirectional stretch properties without containing elastic yarn such as spandex.

In one embodiment, the woven fabric can have a stretch in the warp direction and in the fill direction of greater than about 9%, such as greater than about 10%, such as greater than about 11%. In one embodiment, the fabric can have greater stretch in the fill or weft direction than in the warp direction. For instance, stretch in the warp direction can be from about 6% to about 15% while stretch in the fill direction can be from about 15% to about 25%. In one embodiment, the woven fabric can have from about 8% to about 13% stretch in the warp direction and from about 17% to about 22% stretch in the fill direction.

The weight of the fabric made in accordance with the present disclosure can vary and generally will depend upon the particular application for which the fabric is used. The fabric is designed to withstand inconsistent and repetitive loads with high dynamic forces like wind gusts, heavy rain, air pressure, and the like. In general, the fabric can have a basis weight of from about 3 osy to about 20 osy. For applications where lighter fabrics are desired, the basis weight can be from about 4.5 osy to about 9.5 osy, such as from about 6 osy to about 7.5 osy. When heavier fabrics are needed, however, the basis weight can be from about 8 osy to about 15 osy, such as from about 10 osy to about 13 osy.

In general, the yarns used to construct the fabric are multifilament yarns, although it is believed that monofilament yarns may be used in some applications. In one embodiment, the fabric is made exclusively from inelastic multifilament yarns and does not contain any spun yarns. In one embodiment, the yarns can be made exclusively from polyester or nylon. The denier of the yarns again will vary depending upon the type of product being formed with the fabric. In general, however, the denier of the yarns can be from about 50 to about 900. In one embodiment, the denier of the multifilament yarns may be about 800 or less, such as about 600 or less, such as about 300 or less. In one embodiment, the multifilament yarns can have a denier of from about 250 denier to about 350. In an alternative embodiment, the multifilament yarns may have a denier of from about 400 to about 650. For fabrics having a lower basis weight, the denier of the multifilament yarns can be from about 50 to about 250, such as from about 100 to about 200.

In one embodiment, the denier of the multifilament yarns in the warp direction can be different than the denier of the multifilament yarns in the fill direction. For example, in one embodiment, the denier of the yarns in one direction can be less than the denier of the yarns in a perpendicular direction. In one embodiment, for instance, the multifilament yarns can have a denier in one direction of from about 250 to about 350 and can have a denier in a perpendicular direction of from about 350 to about 650. For example, in one particular embodiment, the warp yarns can have a denier of from about 250 to about 350 while the fill yarns can have a denier of from about 350 to about 650.

As described above, the multifilament yarns of the present disclosure can be highly texturized. Incorporating highly texturized yarns into the fabric and then subjecting the fabric to a bulk or relaxed shrinking process can incorporate significant stretch characteristics into the fabric while also providing the fabric with better dimensional stability properties. Texturized yarns can include crimps or tie downs. For example, multifilament yarns incorporated into the woven fabric of the present disclosure can have greater than about 50 tie downs per meter, such as greater than about 60 tie downs per meter, such as greater than about 70 tie downs per meter, such as greater than about 80 tie downs per meter, such as greater than about 90 tie downs per meter. The yarns generally have less than about 200 tie downs per meter, such as less than about 175 tie downs per meter, such as less than about 150 tie downs per meter. In one embodiment, the yarns have from about 85 tie downs per meter to about 130 tie downs per meter, such as from about 90 tie downs per meter to about 125 tie downs per meter. Tie downs are also referred to as nodes or tats. Tie downs per meter can be measured using a FIBRESCAN LABTEX machine sold commercially by Saurer Fibrevision.

In addition to various other parameters, the yarn density of the fabric made in accordance with the present disclosure can also vary depending upon numerous factors. The yarn density in the warp direction, for instance, can generally be greater than about 40 yarns per inch, such as greater than about 45 yarns per inch, such as greater than about 50 yarns per inch, such as greater than about 55 yarns per inch. The yarn density in the warp direction is generally less than about 70 yarns per inch, such as less than about 60 yarns per inch. In the fill direction, the yarn density is generally greater than about 25 yarns per inch, such as greater than about 30 yarns per inch, such as greater than about 35 yarns per inch, such as greater than about 40 yarns per inch. The yarn density in the fill direction is generally less than about 70 yarns per inch, such as less than about 60 yarns per inch, such as less than about 55 yarns per inch.

In one embodiment, the fabric can be treated with a chemical composition, such as a composition that improves the water resistant properties of the fabric. In accordance with the present disclosure, the water resistant composition is impregnated into the yarns and does not form a film over one surface of the fabric. Thus, the fabric can be treated with a water resistant composition in accordance with the present disclosure while still remaining a non-coated fabric. In this manner, the fabric can have excellent water resistant properties while still remaining breathable and stretchable. The water resistant finish can also improve the abrasion resistant properties of the fabric.

In one embodiment of the present disclosure, the chemical composition is made from a solution of a fluorocarbon polymer that is applied to the fabric. For example, the chemical composition can be made from SHELL TEC 6 which is commercially available from Bolger & Oil-learn Inc. In one embodiment, the fluorocarbon polymer can comprise a C6 to C8 fluorocarbon. Fluorocarbon polymer solutions are also commercially available from other numerous sources and suitable for use herein.

Besides containing a fluorocarbon polymer, the chemical composition can also contain various other additives.

For instance, in one embodiment, the chemical composition can include a water repellent agent. In some embodiments, Phobotex JVA, commercially available from Huntsman International, LLC as an emulsion of paraffin wax and melamine resin, is utilized as a suitable water repellent agent. Other commercially available water repellent agents are also available from other sources and are suitable for use herein.

In addition, the chemical composition can also include an extender to promote durability. In some embodiments, a blocked isocyanate extender can be utilized. In some embodiments, the blocked isocyanate extender is added after copolymerization (i.e., as a blended isocyanate). An example of a suitable blocked isocyanate is HYDROPHOBOL XAN available from Huntsman International, LLC. In accordance with the present disclosure, it has been determined that a blocked isocyanate extender can be beneficially combined with a paraffin wax and melamine resin water repellent agent to impart desirable characteristics to the non-coated fabric described herein. Other commercially available blocked isocyanates are also suitable for use herein.

In one embodiment of the present disclosure, the chemical composition can include a flame retardant composition. The flame retardant can be selected from a variety of suitable flame retardant compounds including phosphorous compounds, such as cyclic phosphonates. An example of a suitable flame retardant is PYROVATEX SVC which is commercially available from Huntsman International, LLC. However, any other suitable flame retardant compounds may also be utilized. The flame retardant compound serves to make the fabric fire resistant. A fire resistant fabric is noncombustible and nonconductive and can be utilized where flammability is a concern.

In this regard, a difficulty in achieving fire resistance with non-coated fabrics while maintaining suitable water resistance performance is that the fire resistance components typically do not permit a fluorocarbon polymer to satisfactorily bond with the fabric in comparison. As described above, paraffin wax and melamine resin water repellent agent components can assist to fill in the fabric pores to help resist water pressure. Still, because some fluorocarbon polymers can have a tendency to burn, the weight percentages of fluorocarbon polymer and fire resistant agent as described herein are controlled in maintaining the fire resistance of the fabric.

Additionally, the chemical composition can contain an antimicrobial agent. The antimicrobial agent serves to help make the fabric mildew resistant. Any suitable antimicrobial agents known in the art can be utilized. In some embodiments, the chemical composition can contain a wetting agent such as isopropyl alcohol.

In one embodiment, the chemical composition can contain from about 1 percent to about 20 percent by weight of a fluorocarbon polymer composition, and particularly from about 2 percent to about 10 percent by weight of the bath. The chemical composition can contain from about 0.1 percent to about 10 percent by weight of water repellent agent and more particularly from about 2 percent to about 5 percent by weight. The chemical composition can contain from about 0.1 percent to about 5 percent by weight of extender and more particularly from about 1 percent to about 3 percent by weight. The chemical composition can contain from about 1 percent to about 20 percent by weight of fire resistant agent and more particularly from about 5 percent to about 15 percent by weight. Further, the chemical composition can contain an antimicrobial and a wetting agent in an amount from about 0.1 percent to about 5 percent by weight, and particularly from about 0.1 percent to about 1 percent by weight of the bath.

In order to produce a liquid resistant fabric in accordance with the present disclosure, the fabric is first constructed. In one embodiment for instance, the fabric is woven with a relatively loose weave using highly textured multifilament yarns. After the fabric is woven, the fabric is subjected to a shrinking process, which shrinks the fabric in both the warp direction and the fill direction. The use of highly texturized yarns in conjunction with controlled shrinkage of the fabric results in a fabric having excellent stretch properties while still remaining dimensionally stable.

Various different techniques can be used in order to shrink the fabric. For example, in one embodiment, the fabric can be exposed to higher temperatures in a relaxed state that causes the fabric to shrink.

In one embodiment, for instance, the fabric is exposed to heat and optionally pressure by contacting the fabric with a hot aqueous solution, such as water, in a pressurized vessel. For example, in one embodiment, the fabric can be fed through a jet dye machine in a relaxed state and exposed to water at a relatively high temperature. The temperature of the water, for instance, can be above about 180° F., such as above about 200° F., such as above about 210° F., such as above about 220° F., such as above about 230° F. The temperature of the water is generally below about 300° F. The water can be in the form of steam or can be in a liquid state. When in a liquid state, the fabric can be contained in a pressurized vessel when the temperature of the water is above 220° F.

In one particular embodiment, the woven fabric is fed through a jet dye machine that includes a nozzle for dispensing water at a temperature above 220° F. The fabric is circulated within the jet dye machine for about 1 to about 3 hours which causes the relaxed fabric to shrink in both the warp direction and the fill direction. For instance, the fabric can shrink at least 10% in both the warp direction and the fill direction, such as at least about 13%, such as at least about 15%, such as at least about 18%, such as at least about 20%, such as at least about 25%, and generally less than about 40% in both the warp direction and the fill direction.

After being subjected to a shrinking process, the woven fabric is dried. In general, the fabric can be dried in a relatively relaxed state in order to maintain the stretch properties. In one embodiment, for instance, the fabric can be placed on a tenter frame and subjected to a hot air blanket, such as air at a temperature of greater than about 200° F., such as greater than about 250° F., such as greater than about 280° F., and generally less than about 400° F., such as less than about 350° F. In one embodiment, the fabric is placed on the tenter frame and the fabric is overfed in order to maintain the fabric in a relaxed condition. While on the tenter frame, one or more chemical finishes can be applied to the fabric. For instance, in one embodiment, a water repellant composition can be applied to the fabric and cured.

In one embodiment, a chemical composition is applied to both sides of the fabric. The composition can be applied to the fabric by plasma treatment, sprayed on the fabric, dipped into the composition, or printed on to the fabric. In one embodiment, the chemical composition is not coated on the fabric but rather substantially impregnated on the fabric.

In one embodiment, the composition is applied to the fabric at a wet pick up rate of from about 10% to about 50% by weight of the fabric, particularly from about 20% to about 25% by weight.

The outdoor cover product or fabric made in accordance with the present disclosure can have a unique combination of properties that makes the fabric well suited for use in outdoor applications. For instance, the fabric can have a spray rating when tested according to AATCC Test 22 of at least 90, such as at least 95, such as even a rating of 100. The outdoor cover product or fabric can display a hydrostatic pressure when tested according to AATCC Test 127 of at least 10 cm, such as at least 11. The hydrostatic pressure is generally less than about 25 cm.

The outdoor cover product or fabric can also have excellent air permeability properties. For instance, the fabric, when tested according to ASTM Test D737, can have an air permeability of greater than about 50 cfm, such as greater than about 60 cfm, such as greater than about 70 cfm. The air permeability is generally less than about 100 cfm.

Preferred embodiments of the present disclosure involve the use of the fabric in the construction of materials for outdoor applications. Items that benefit from improved hydrostatic pressure and UV resistance may be constructed from the fabric described herein. For example, automotive and marine applications, awnings, casual outdoor furniture, tents, umbrellas, covers, canopies, banners, military applications, sun shades, protective engine or seat covers, and the like may be constructed using the fabric of the present disclosure. Additionally, many items benefit from the fire resistant capabilities of the fabric of the present disclosure. Such items can include, without limitation, indoor or outdoor awnings, tents, canopies, umbrellas, casual outdoor furniture, and the like.

With Reference to FIG. 1, an outdoor awning or shade 10 is illustrated. As shown, the shade 10 can be attached to a structure or building. If desired, the shade 10 can be associated with a frame for maintaining a certain shape. In the embodiment illustrated in FIG. 1, the shade 10 is connected on 3 corners to the budding and the ground. On the remaining corner, the shade 10 is attached to a frame 12.

Figure 2:
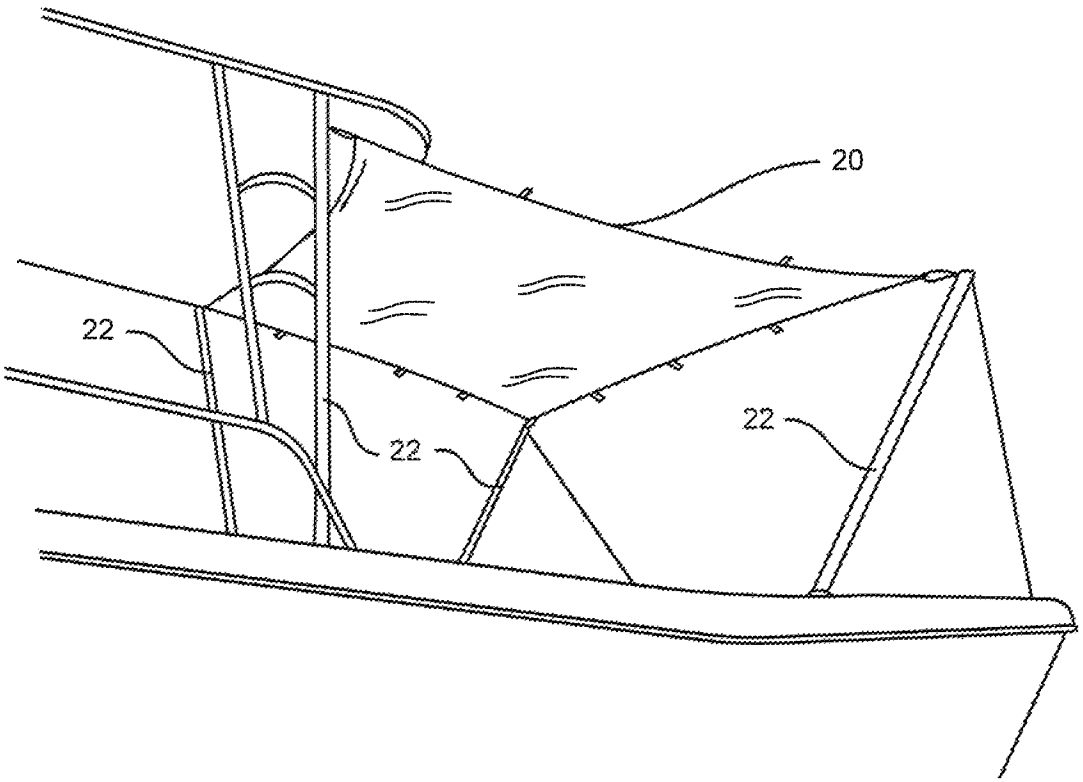
FIG. 2 represents another embodiment of a shade structure in accordance with the present disclosure.

Referring to FIG. 2, a shade structure for a boat is illustrated. The shade structure 20 is attached to various frame members 22. The frame members 22 can form a frame structure and can be formed from polls or the like. The shade 20 can extend over an open part of the boat for providing shade to the occupants.

Figure 3:
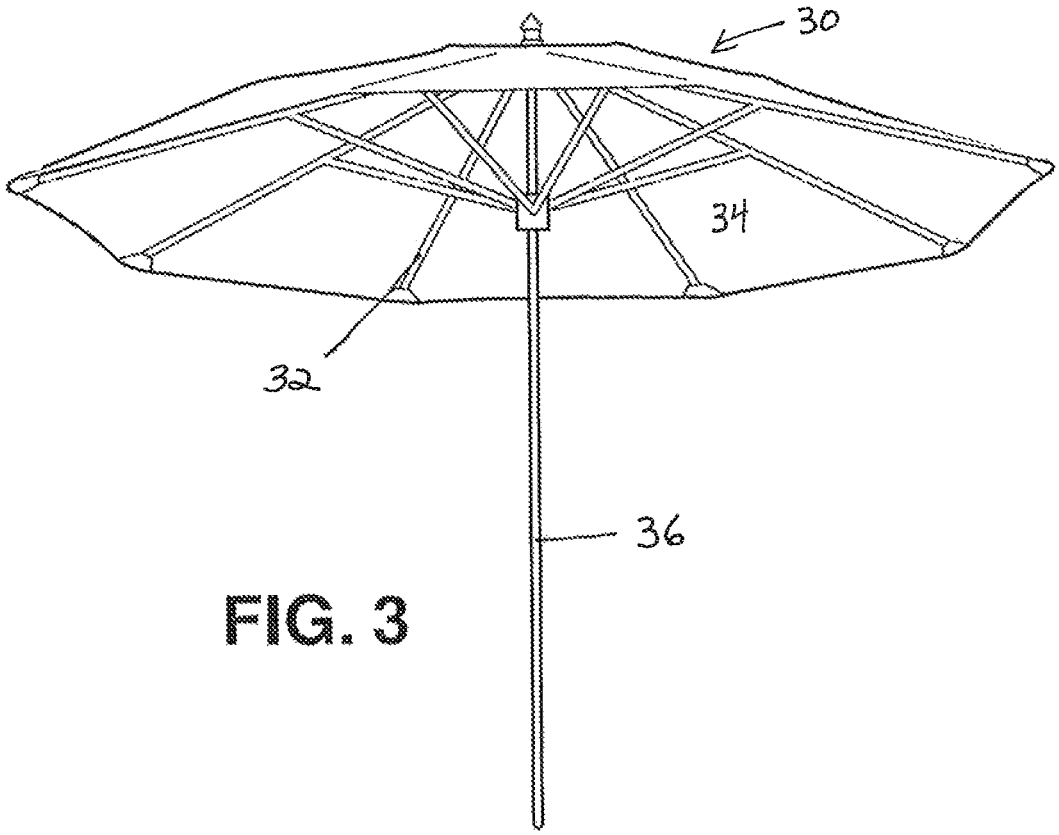
FIG. 3 represents an umbrella in accordance with one embodiment of the present disclosure.

With reference to FIG. 3, an umbrella 30 is illustrated. The umbrella 30 includes a frame 32. The frame 32 can extend outward from a central shaft 36. The frame 32 is covered by fabric or outdoor cover product 34 as described in the present disclosure.

Figure 4:
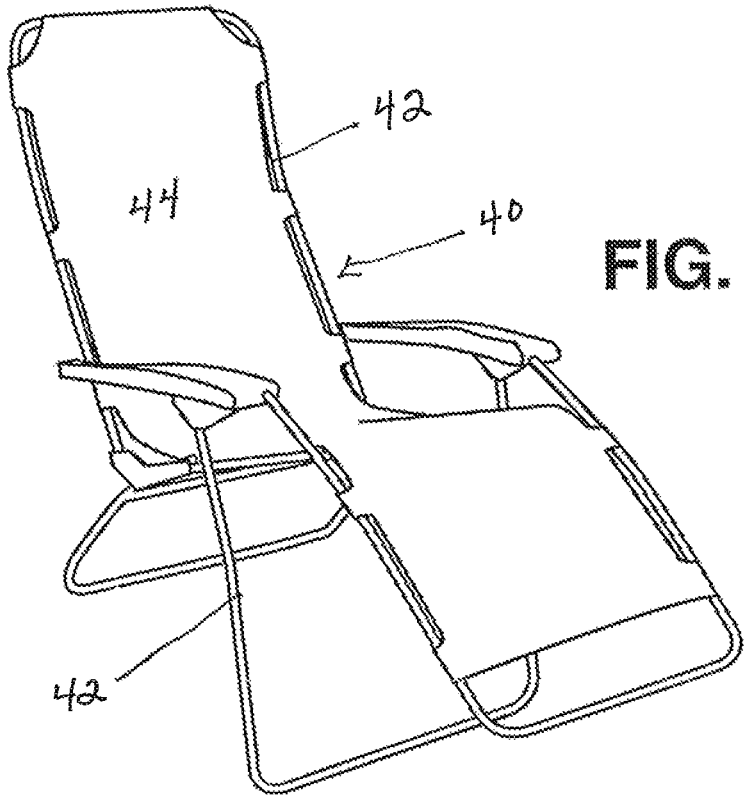
FIG. 4 represents a piece of outdoor furniture in accordance with one embodiment of the present disclosure.

Finally, with reference to FIG. 4, a piece of outdoor furniture is illustrated, specifically a folding chair 40. The folding chair 40 includes support elements 42. The support elements 42 are covered by fabric or outdoor cover product 44 as described in the present disclosure. It should be understood that the fabric may include padding or cushioning as would be known in the art.

Examples

The present disclosure may be better understood with reference to the following examples.

Three outdoor cover products were made in accordance with the present disclosure. One product contained a fabric having a basis weight of 5.79 osy (Sample No. 1), another fabric had a basis weight of 7.23 osy (Sample No. 2), and the third fabric had a basis weight of 6.49 osy (Sample No. 3). The fabrics were constructed from solution dyed multifilament yarns containing polyester filaments. The yarns contained a UV stabilizer. The fabrics were made from multifilament yarns having a denier of 300. The multifilament yarns were highly texturized and contained from about 100 to about 125 tie downs per meter.

The yarns were woven into a fabric and subjected to a shrink process by being fed to a jet dye machine and exposed to water at a temperature above 220° F. at a relaxed state. The fabric was then relaxed dried.

The fabrics were also treated with a water resistant composition. The water resistant composition comprised SHELL TEC 6 finish commercially available from Bolger and O'Hearn, Inc. The treated fabric was overfed and cured on a tenter frame.

The fabrics were tested for various properties and the following results were obtained:

| | Method | Sample No. 1 | Sample No. 2 | Sample No. 3 |
|---|---|---|---|---|
| Weight, oz/sq yd | ASTM D 3776 | 5.79 | 7.23 | 6.49 |
| Width, Inches | ASTM D 3774 | 61 | 61 | 60¾ |
| Ends/Inch | ASTM D 3775 | 55 | 55 | 55.5 |
| Picks/Inch | ASTM D 3775 | 51 | 37.5 | 41 |
| Spray Rating, | AATCC | 100 | 100 | 100 |
| Hydro static, cm | AATCC 127 | 11 | 11 | 12 |
| Perm, CFM | ASTM D 737 | 80 | 58 | 75 |
| Oil repellency | AATCC 118-1983 | 6 | 6 | 6 |
| Water Repellency | AATCC- Dupont | 6 | 6 | 6 |
| Tensile, Pounds, W × F | ASTM D 5034 | 234 × 228 | 225 × 290 | 230 × 259 |
| % Elongation, W × F | ASTM D 5034 | 88 × 95 | 88 × 100 | 90 × 95 |
| Tongue T, #'s, W × F | ASTM D 2261 | 15.7 × 15.4 | 29.8 × 18.9 | 20.1 × 15.7 |
| % Stretch, warp | | 13 | 11 | 12 |
| % Stretch fill | | 18 | 19 | 20 |

These and other modifications and variations to the present disclosure may be practiced by those of ordinary skill in the art, without departing from the spirit and scope of the present disclosure, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to limit the disclosure so further described in such appended claims.

What is claimed:

1. An outdoor cover product comprising:

a cover having an interior surface and an exterior surface, the cover having a shape adapted to cover an outdoor structure, the exterior surface of the cover having a UV rating of at least 800 hours and having a spray rating of at least 90, the cover comprising a woven fabric comprised of yarns, the yarns comprising multifilament yarns, the multifilament yarns comprising texturized yarns, the texturized yarns having greater than about 90 tie downs per meter and less than about 175 tie downs per meter, the fabric having a warp direction and a fill direction, the fabric containing from about 40 yarns to about 70 yarns per inch in the warp direction and containing from about 25 yarns to about 70 yarns per inch in the fill direction, the multifilament yarns extending in both the warp direction and the fill direction, the fabric having a stretch of at least 8% in the warp direction and a stretch of at least 8% in the fill direction when tested according to ASTM Test D3107 at a load of 4 lbs;

wherein the fabric has a hydrostatic pressure when tested according to AATCC 127 of from about 11 cm to about 15 cm, a basis weight of from about 4.5 osy to about 9.5 osy, and an air permeability of greater than about 50 cfm when tested according to ASTM Test D737, wherein the fabric has been subjected to a shrinking process in a relaxed state.

2. An outdoor cover product as defined in claim 1, wherein the multifilament yarns have a denier of from about 50 to about 800.

3. An outdoor cover product as defined in claim 1, wherein the multifilament yarns have a denier of from about 250 to about 350.

4. An outdoor cover product as defined in claim 1, wherein the multifilament yarns extending in the warp direction have a denier of from about 250 to about 350 and wherein the multifilament yarns extending in the fill direction have a denier of from about 350 to about 650, the denier of the warp yarns being less than the denier of the fill yarns.

5. An outdoor cover product as defined in claim 1, wherein the fabric contains from about 50 yarns to about 70 yarns per inch in the warp direction and contains from about 30 yarns to about 45 yarns per inch in the fill direction.

6. An outdoor cover product as defined in claim 1, wherein the fabric has a stretch of at least 10% in the warp direction and a stretch of at least 10% in the fill direction.

7. An outdoor cover product as defined in claim 1, wherein the fabric has a stretch of at least 15% in the fill direction.

8. An outdoor cover product as defined in claim 1, wherein the multifilament yarns are solution dyed.

9. An outdoor cover product as defined in claim 1, wherein the fabric is impregnated with a water resistant finish.

10. An outdoor cover product as defined in claim 9, wherein the fabric is impregnated with a flame retardant composition.

11. An outdoor cover product as defined in claim 1, wherein the fabric is non-coated and is not laminated to any other fabric or film layers.

12. An outdoor cover product as defined in claim 1, wherein the multifilament yarns contained in the fabric contain polyester filaments and the polyester filaments comprise at least 80% by weight of the fabric.

13. An outdoor cover product as defined in claim 1, wherein the outdoor cover product comprises a boat cover.

14. An umbrella comprising a frame, the frame being covered by the outdoor cover product of claim 1.

15. An outdoor cover product as defined in claim 1, wherein the outdoor cover product comprises a furniture cover.

16. An outdoor cover product as defined in claim 1, wherein the texturized yarns have about 100 to about 125 tie downs per meter.

17. An outdoor cover product as defined in claim 1, wherein the fabric contains yarns extending in the warp direction in an amount of from 40 yarns per inch to 70 yarns per inch and in the fill direction in an amount of from 40 yarns per inch to 70 yarns per inch.

18. An outdoor cover product as defined in claim 1, wherein the fabric has been dried in a relaxed state.

19. An outdoor cover product as defined in claim 1, wherein the fabric has an air permeability of less than about 100 cfm when tested according to ASTM Test D737.

20. An outdoor cover product as defined in claim 1, wherein the shrinking process further includes subjecting the fabric to water at a temperature of greater than about 200° F.

21. An outdoor cover product as defined in claim 1, wherein:

the multifilament yarns extending in the warp direction have a denier of from about 250 to about 350 and wherein the multifilament yarns extending in the fill direction have a denier of from about 350 to about 650;

the texturized yarns have about 100 to about 125 tie downs per meter; and the fabric has an air permeability of greater than about 50 cfm and less than about 100 cfm when tested according to ASTM Test D737.

* * * * *